US009851051B2

(12) United States Patent
Chang et al.

(10) Patent No.: US 9,851,051 B2
(45) Date of Patent: Dec. 26, 2017

(54) X-BEAM STRUCTURE AND PRESSURE TANK HAVING X-BEAM STRUCTURE

(71) Applicant: KOREA ADVANCED INSTITUTE OF SCIENCE AND TECHNOLOGY, Daejeon (KR)

(72) Inventors: Dae Jun Chang, Daejeon (KR); Pal G Bergan, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 121 days.

(21) Appl. No.: 14/440,721

(22) PCT Filed: Nov. 8, 2012

(86) PCT No.: PCT/KR2012/009396
§ 371 (c)(1),
(2) Date: May 5, 2015

(87) PCT Pub. No.: WO2014/073719
PCT Pub. Date: May 15, 2014

(65) Prior Publication Data
US 2015/0260339 A1 Sep. 17, 2015

(51) Int. Cl.
*F17C 1/02* (2006.01)
*E04B 1/19* (2006.01)
*F17C 1/00* (2006.01)

(52) U.S. Cl.
CPC ..... *F17C 1/02* (2013.01); *E04B 1/1903* (2013.01); *F17C 1/002* (2013.01);
(Continued)

(58) Field of Classification Search
CPC ..... Y10T 403/44; E04B 1/1903; E04B 2001/1936; E04C 2003/0478; F17C 1/02;
(Continued)

(56) References Cited

U.S. PATENT DOCUMENTS 2,218,689 A * 10/1940 Stewart ..... B63B 3/14 114/116
3,545,123 A * 12/1970 Muller ..... A63H 33/046 403/295

(Continued)

FOREIGN PATENT DOCUMENTS

| | | |
|---|---|---|
| EP | 0 006 016 B1 | 8/1982 |
| WO | 2011/053155 A1 | 5/2011 |
| WO | 2012/148154 A2 | 11/2012 |

OTHER PUBLICATIONS

International Search Report for corresponding PCT application No. PCT/KR2012/009396.

*Primary Examiner* — Brent W Herring
(74) *Attorney, Agent, or Firm* — Hauptman Ham, LLP

(57) ABSTRACT

Provided is an X-beam structure including: a plurality of beams extending in X-axis, Y-axis, and Z-axis directions and formed in a lattice pattern and a plurality of cross intersections at which an X-axis beam, a Y-axis beam, and a Z-axis beam meet one another, wherein in the X-beam structure in which a cross section of each beam has the geometry of a right-angled X, and the beam intersections are formed with one continuous beam and the two other joining beams are attached and welded onto the continuous beam.

12 Claims, 11 Drawing Sheets

(52) U.S. Cl.
CPC ..... *E04B 2001/1936* (2013.01); *F17C 2201/0109* (2013.01); *F17C 2201/0128* (2013.01); *F17C 2201/0147* (2013.01); *F17C 2201/0152* (2013.01); *F17C 2201/052* (2013.01); *F17C 2203/013* (2013.01); *F17C 2223/0123* (2013.01); *F17C 2223/035* (2013.01); *F17C 2223/036* (2013.01); *F17C 2260/016* (2013.01); *F17C 2270/0105* (2013.01); *Y10T 403/44* (2015.01)

(58) Field of Classification Search
CPC ..... F17C 1/002; F17C 2223/035; F17C 2260/016; F17C 2223/036; F17C 2223/0123; F17C 2270/0105; F17C 2201/052; F17C 2201/0152; F17C 2201/0147; F17C 2201/0128; F17C 2201/0109; F17C 2203/013
USPC ..... 52/836, 838, 844, 845, 846, 848, 854, 52/855
See application file for complete search history.

(56) References Cited

U.S. PATENT DOCUMENTS 3,593,477 A * 7/1971 Briggs ..... E04B 1/185 52/253
3,792,882 A * 2/1974 Varichon ..... E04B 1/19 403/171
3,938,297 A * 2/1976 Sato ..... E04B 1/2403 403/188
3,996,102 A 12/1976 Thome
4,054,392 A * 10/1977 Oppenheim ..... F16B 7/18 403/175
5,259,160 A * 11/1993 Carannante ..... E04B 1/215 52/252
5,289,665 A * 3/1994 Higgins ..... E04B 1/2403 211/191
5,372,447 A * 12/1994 Chung ..... E04B 1/5831 403/169
5,620,273 A * 4/1997 Heyn ..... A47B 47/005 403/170
5,803,782 A * 9/1998 Selton ..... A47B 47/0016 446/125
5,941,527 A * 8/1999 Selton ..... A63F 3/00214 273/160
6,792,732 B2 * 9/2004 Strassle ..... A47B 47/0016 403/171
7,310,920 B2 * 12/2007 Hovey, Jr. ..... E04B 1/24 52/282.1
7,621,099 B2 * 11/2009 Simmons ..... B23K 31/12 29/822
7,637,076 B2 * 12/2009 Vaughn ..... E02D 27/34 403/169
7,703,244 B2 * 4/2010 Suzuki ..... E04B 1/24 403/169
7,716,820 B2 * 5/2010 Simmons ..... B23K 31/12 29/700
8,915,042 B2 * 12/2014 Ahn ..... E04B 1/24 52/236.6
2002/0189191 A1 * 12/2002 Strassle ..... A47B 47/0016 52/655.2
2005/0055954 A1 * 3/2005 Simmons ..... B23K 31/12 52/633
2007/0194051 A1 8/2007 Bakken et al.
2007/0209314 A1 * 9/2007 Vaughn ..... E02D 27/34 52/838
2011/0308197 A1 * 12/2011 Wallace ..... E02D 5/24 52/846
2014/0034653 A1 * 2/2014 Chang ..... F17C 3/025 220/581
2016/0356420 A1 * 12/2016 Chang ..... F17C 3/025

* cited by examiner

【Figure 1】
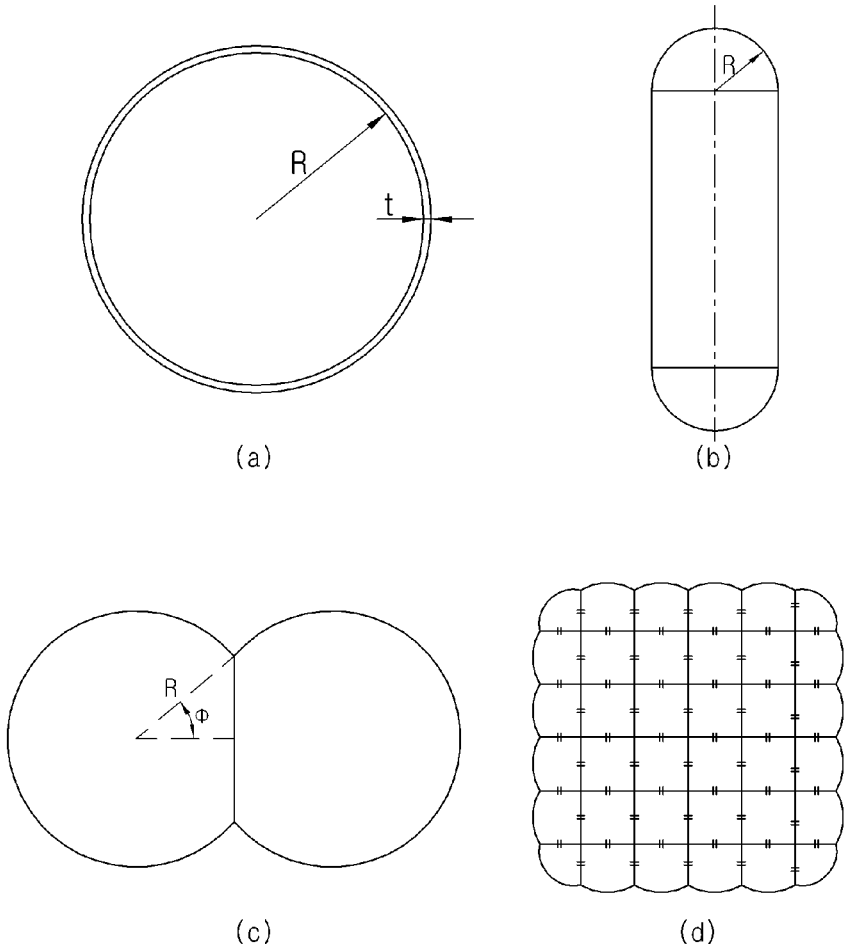

【Figure 2】
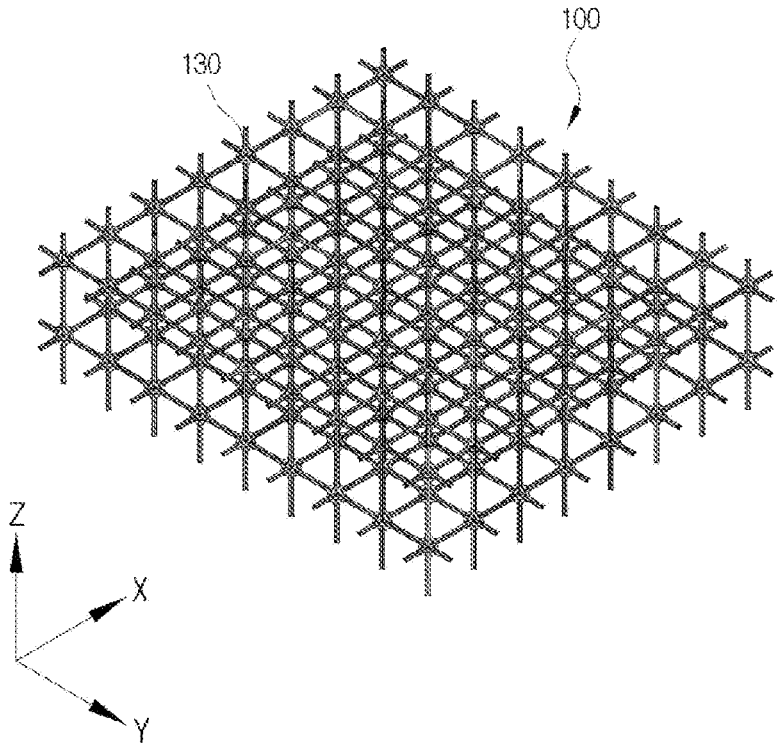

【Figure 3】
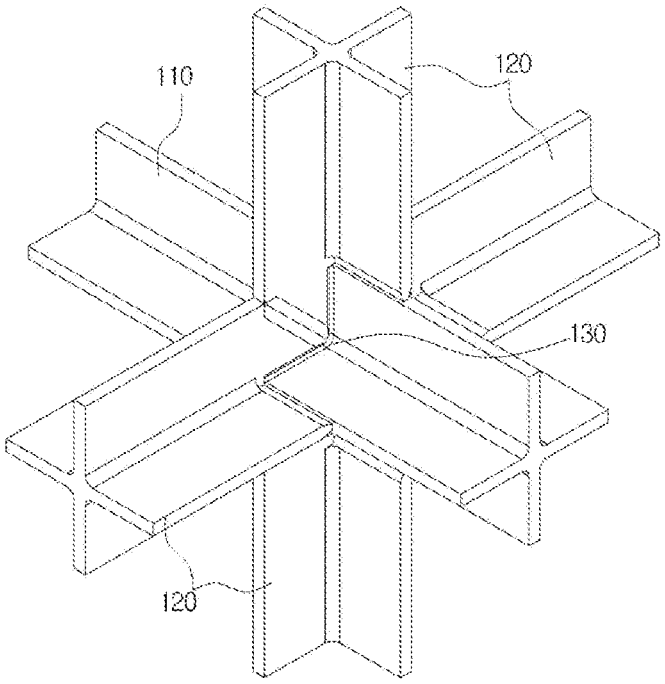

【Figure 4】
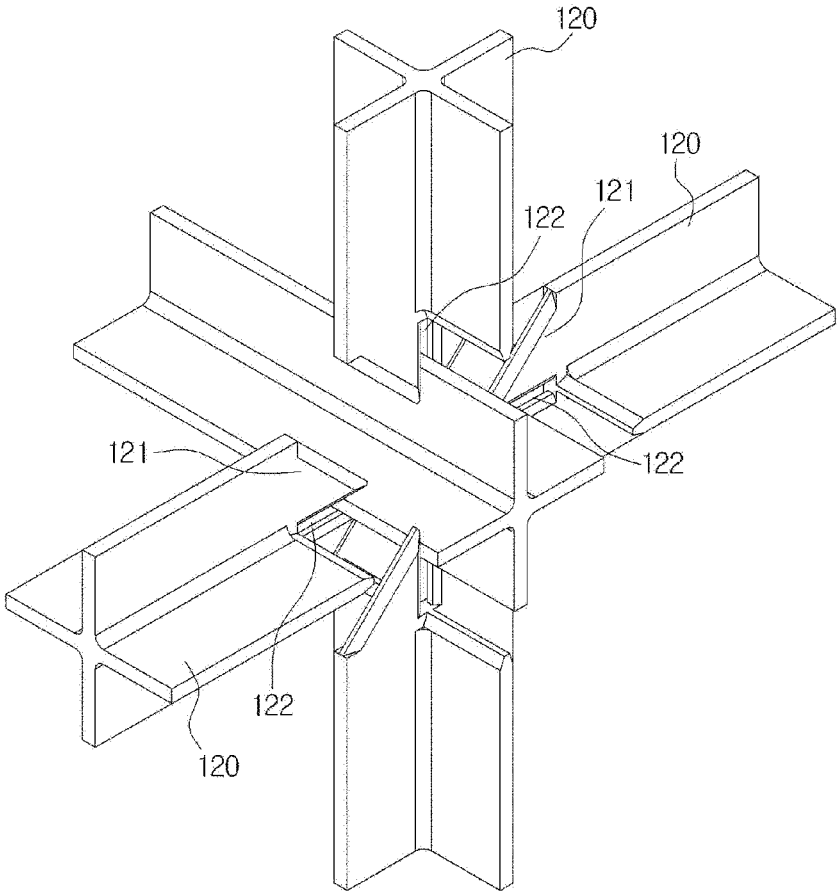

【Figure 5】
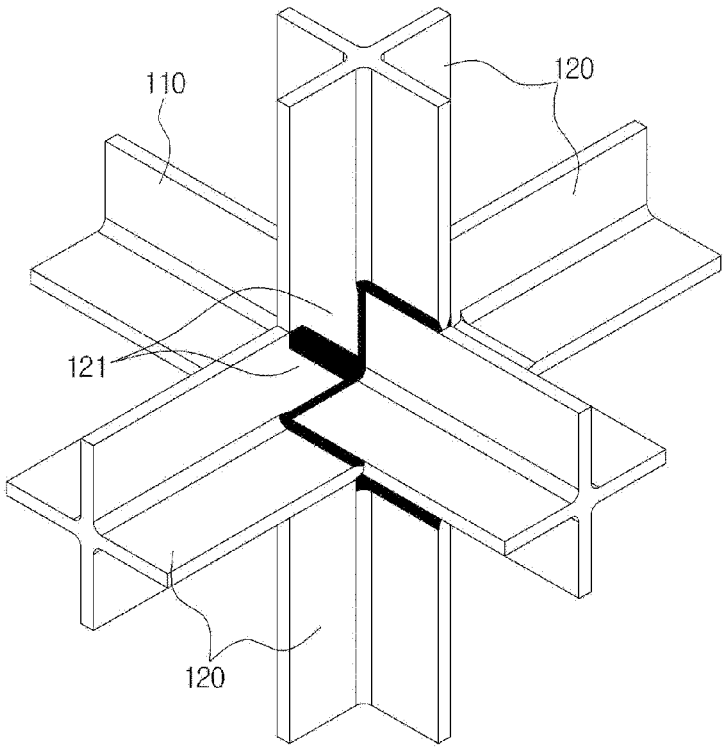

【Figure 6】
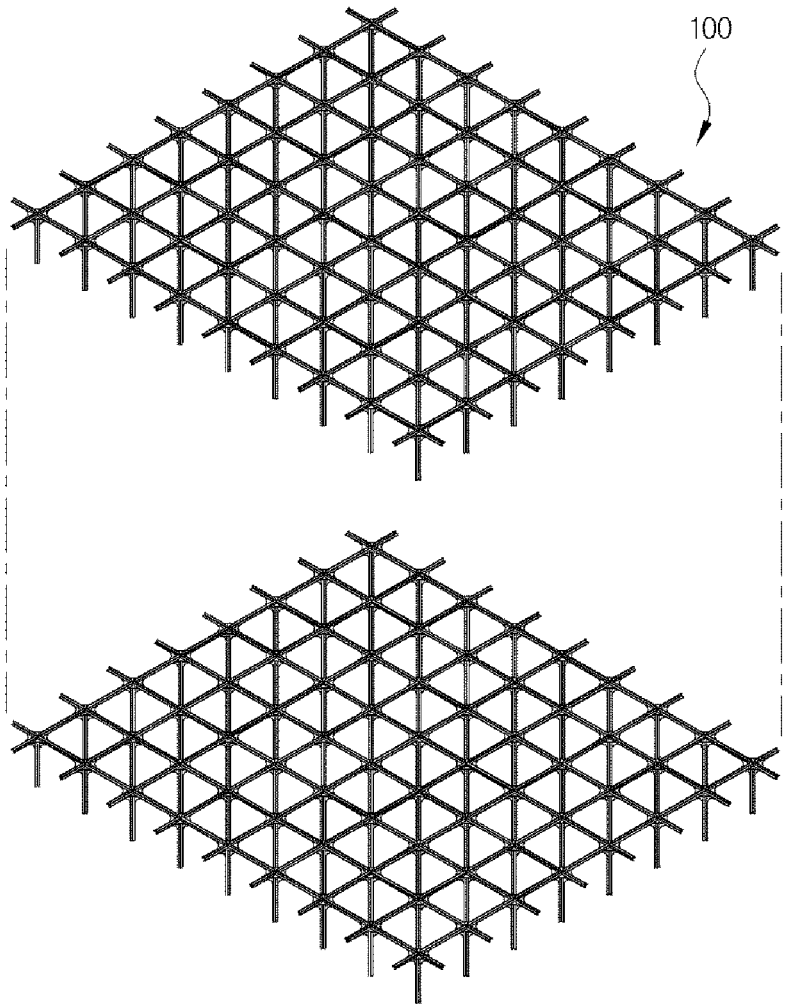

【Figure 7】
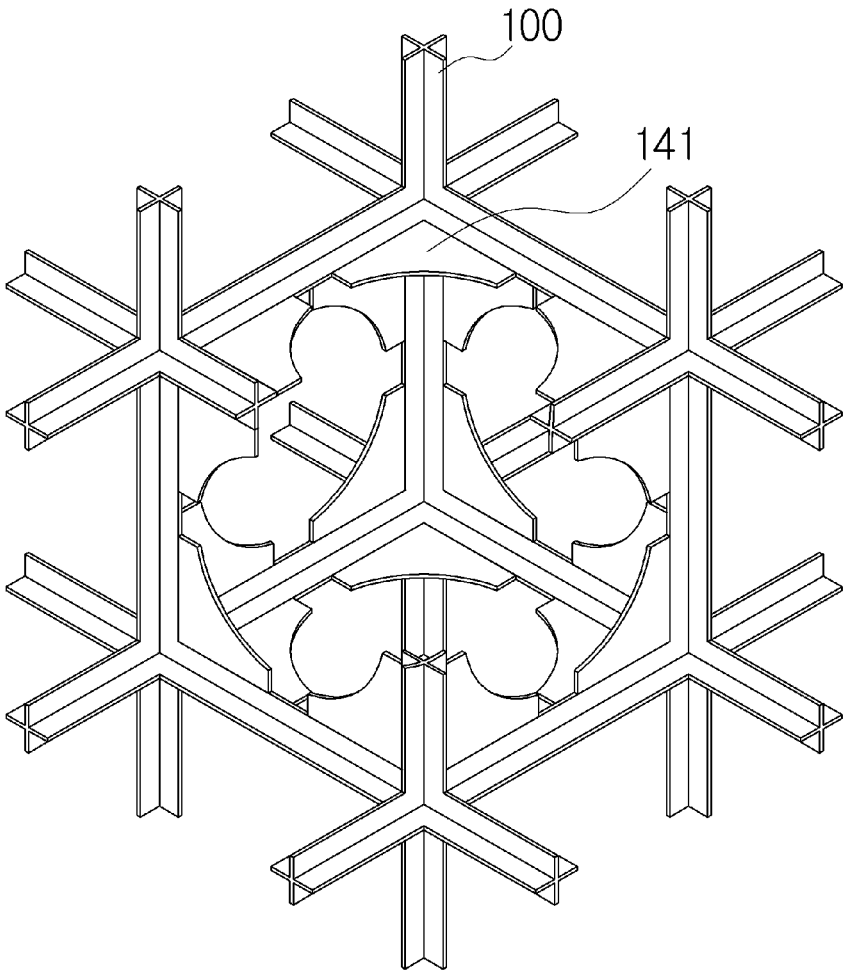

【Figure 8】
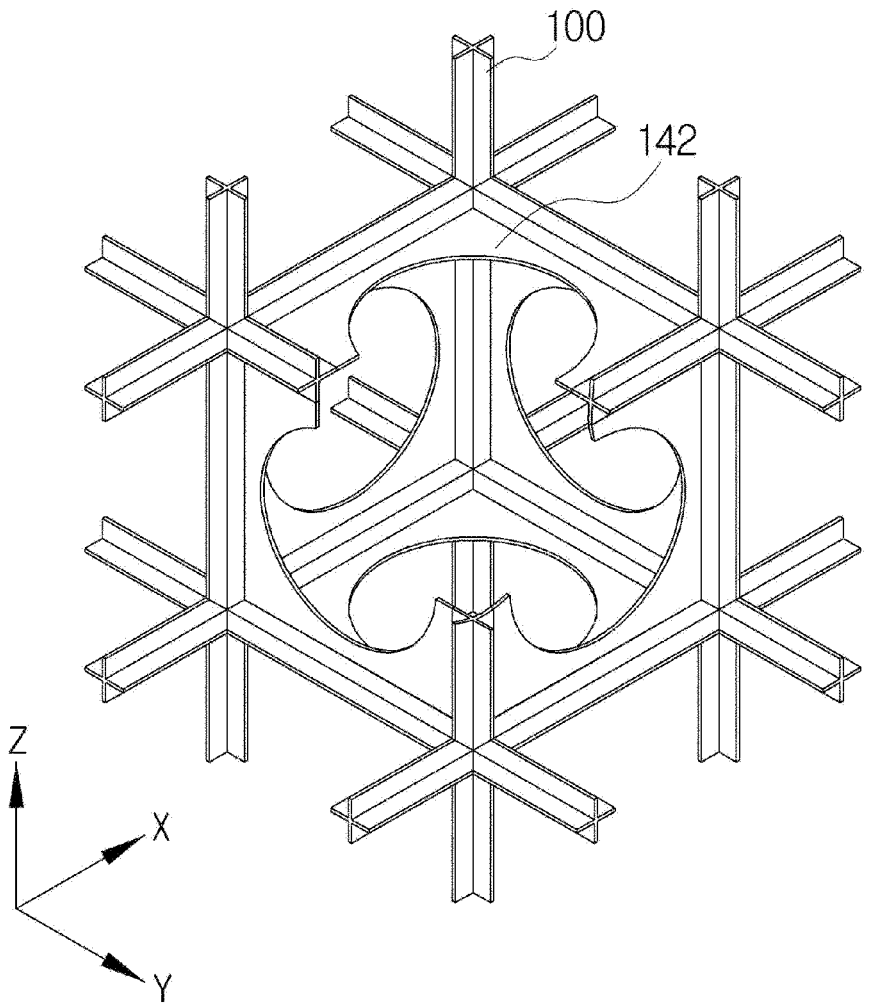

【Figure 9】
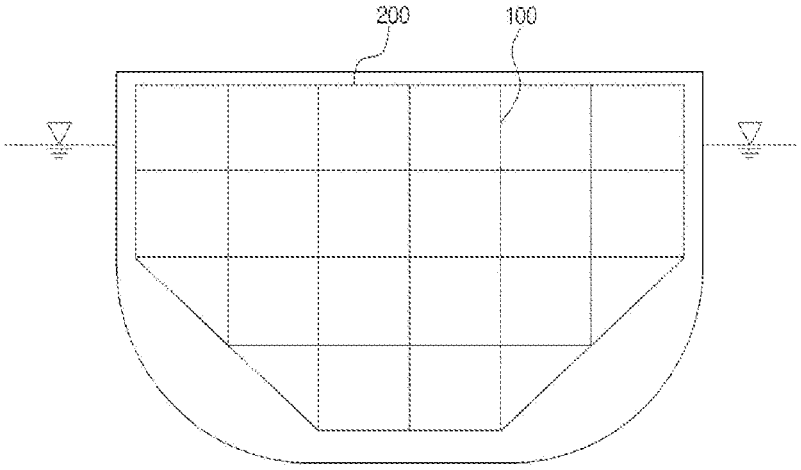

【Figure 10】
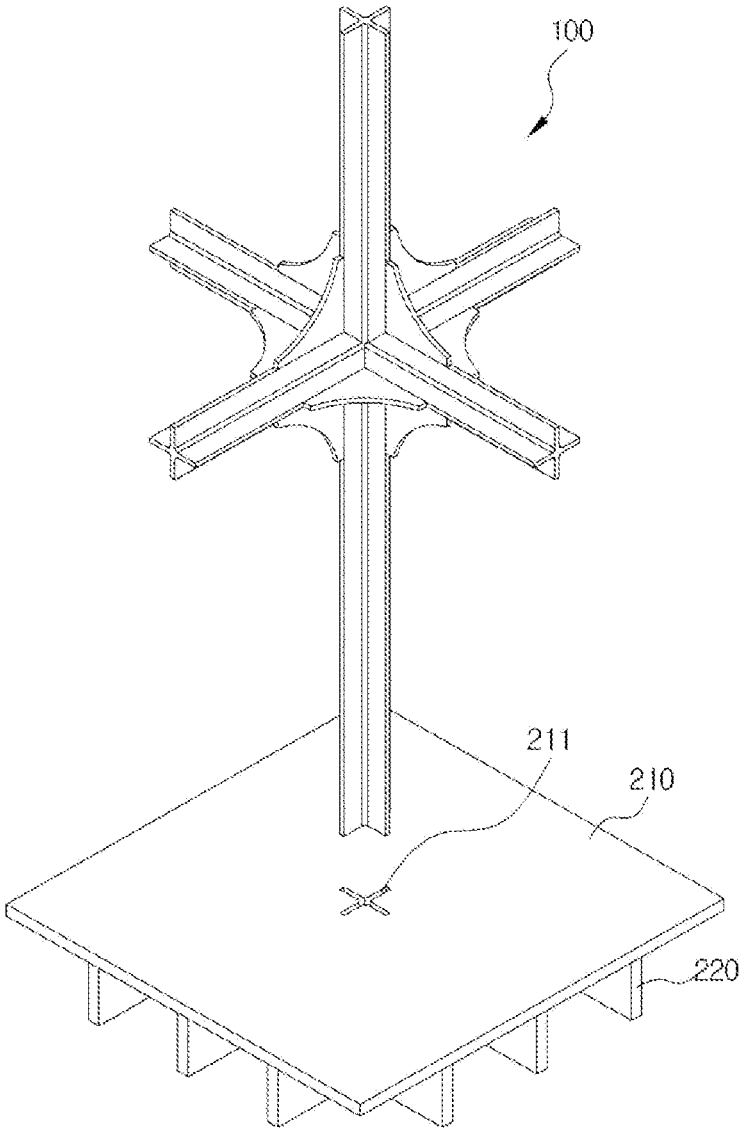

【Figure 11】
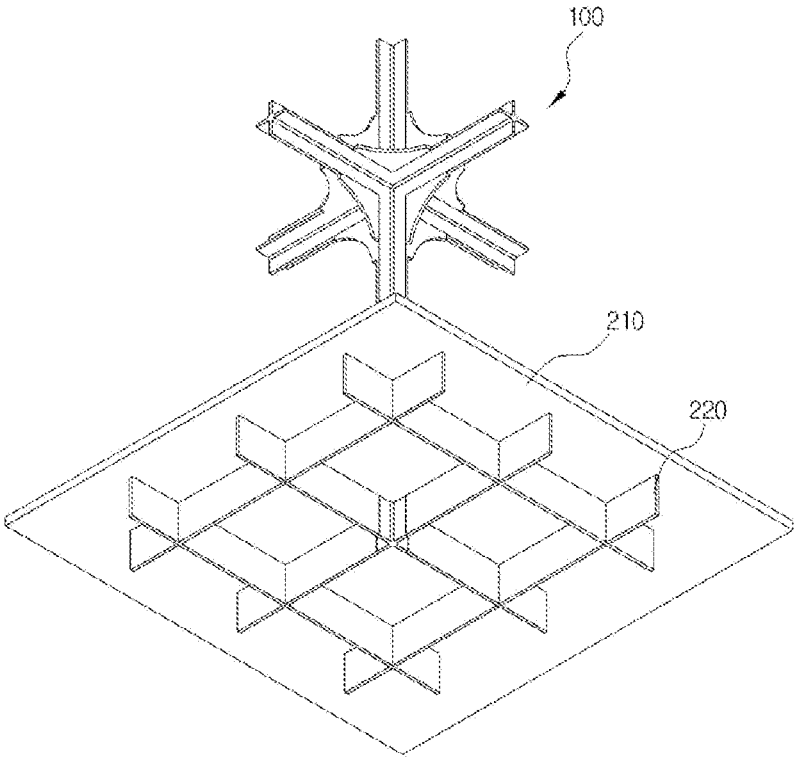

X-BEAM STRUCTURE AND PRESSURE TANK HAVING X-BEAM STRUCTURE

TECHNICAL FIELD

The present invention relates to a pressure tank, and in particular, to a pressure tank having a beam lattice structure capable of withstanding pressure generated by high pressure gas by including an X-beam lattice structure and a reinforcing member thereof in a prismatic-shaped pressure tank and increasing space efficiency and material consumption ratio by being manufactured in a prismatic shape.

BACKGROUND ART

In order to accommodate a high-pressure fluid, various shapes of pressure tanks have been developed and many patents thereof have been filed.

FIG. 1 shows a pressure tank according to the related art, wherein FIG. 1*a* is a spherical pressure tank. FIG. 1*b* is a cylindrical pressure tank. FIG. 1*c* is a lobed pressure tank, and FIG. 1*d* is a cellular pressure tank.

Efficiency of a tank may be determined by volume efficiency and material consumption ratio.

$$\xi = \frac{V_{tank}}{V_{prism}} \quad \text{[Equation 1]}$$

ξ $V_{tank}$ $V_{prism}$ The above Equation 1 can obtain the volume efficiency. In the above Equation 1, represents the volume efficiency, represents the volume of the tank, and represents the volume of the smallest rectangular parallelepiped box-volume which fully surrounds the tank.

ξ The higher the value of, the larger the volume efficiency of the tank, which means better utilization of the practical space consumed by the tank.

$$\eta = \frac{V_{material}}{V_{stored}} \frac{p}{\sigma_a} \quad \text{[Equation 2]}$$

η $V_{material}$ $V_{stored}$ The above Equation 2 expresses the material consumption ratio. In the above Equation 2, represents the material consumption ratio, the represents the volume of the material utilized to manufacture the tank, and the represents the amount of a fluid that can be filled in the tank.

η The lower the value of, the smaller the amount of material configuring the tank of the same volume, which means better increase in the efficiency of the tank.

TABLE 1

| Type of Pressure Tank | $\xi = \frac{V_{tank}}{V_{prism}}$ | $\eta = \frac{V_{material}}{V_{stored}} \frac{p}{\sigma_a}$ |
|---|---|---|
| Sherical Type | 0.52 | 1.5 |
| Cylindrical Type | 0.78 | 1.73-2.0 |
| Lobe Type | 0.85 | 1.73-2.0 |
| Cellular Type | <1.0 | 1.73-2.0 |

The above Table 1 represents the volume efficiency and the material consumption ratio of the tank according to the related art. It should be noted that the material ratios for cylindrical, lobe, and cellular tanks do not include the end enclosures such that the real material ratios will be somewhat higher than shown in the table.

As can be appreciated from the above Table 1, the cellular tank has the most efficient volume efficiency, and the cylindrical tank, the lobed tank, and the cellular tank have about similar material consumption ratios.

It is to be noted that the lobe tanks are made by combining and overlapping two or more cylindrical tanks, have an interior wall spanning between the intersection lines, and are normally capped with doubly curved end shells. Such designs are rather complicated and difficult to manufacture and significant bending occur in the tank walls. The cellular tank has high volume efficiency and is efficient in that it does not require increased plate thickness for large-capacity tanks; one may just increase the number of cells. However, the cellular tank cannot be easily manufactured due to a rather complicated shape; moreover, the end capping problem is a particular challenge.

In all tank cases where there are curved shells involved, i.e. spherical, cylindrical, lobe and cell tanks, it is very difficult if not impossible to design for complete double barrier of the exterior walls.

CITATION LIST

Patent Document

Korean Patent Laid-Open Publication No. 2003-0050314

DISCLOSURE

Technical Problem

An objective of the present invention is to provide a prismatic-shaped pressure tank, in particular, a pressure tank capable of extending its size to any dimension thereof and withstanding high pressure and temperature change of an interior fluid.

Another objective of the present invention is to provide a pressure tank having high volume efficiency, in particular, a pressure tank capable of preventing a fluid from being leaked from the inside of the pressure tank.

Still another objective of the present invention is to provide a pressure tank capable of reducing a sloshing phenomenon due to a fluid and distributing force applied to a tank wall.

Technical Solution

In one general aspect, an X-beam structure includes: a plurality of beams extending in X-axis, Y-axis, and Z-axis directions and formed in a lattice shape and a plurality of cross intersections 130 at which an X-axis beam, a Y-axis beam, and a Z-axis beam meet one another, wherein a cross section of each beam has a right-angled X shape, and the cross portions 130 are provided with continuous beams 110 in which one beam is continuously formed and attached beams 120 welded to the continuous beam 110.

The X-axis beam may be spaced apart from an X-axis beam positioned on the same plane and adjacent thereto at the same distance, the Y-axis beam may be spaced apart from the Y-axis beam positioned on the same plane and adjacent thereto at the same distance, and the Z-axis beam may be spaced apart from the adjacent Z-axis beam positioned on the same plane and adjacent thereto at the same distance.

The attached beams 120 may have protrusions 121 in an angular shape formed at ends thereof and central portions of the protrusions 121 may be provided with cut-outs 122 which are consistent with the cross-sectional shape of the continuous beams 110.

The cross intersection 130 may be formed so that a portion at which the cut-out 122 contacts the continuous beam 110 and a portion at which the protrusion 121 contacts the adjacent protrusion 121 have a smaller cross sectional area toward the outside from the inside. The reason for this is to accommodate beam joining in terms of welding.

An end surface of the cross intersections 130 may be welded to intersection brackets 141 and 142.

In another general aspect, a pressure tank having the X-beam structure 100 as described above further includes: a tank body 200 having a high-pressure fluid accommodated therein and manufactured in a prismatic shape, wherein the X-beam structure 100 is disposed in the tank body 200 and reaches the other opposite side wall from one side wall of the tank body 200 and is regularly orthogonally-arranged.

Beam structure openings 211 may be provided at a place at which the tank wall 210 of the tank body 200 contacts the X-beam structure 100 in the same shape as the cross section of the X-beam structure 100 and the X-beam structure 100 may be extended to the outside of the wall by being inserted through the beam structure opening 211.

An outer surface of the tank wall 210 may be provided with stiffening members 220 in an orthogonal pattern and the beam structure 100 may be welded to the stiffening members 220 after being inserted through the tank wall 210 the stiffening members 220.

The distance from the tank wall 210 to the most adjacent beam crossing intersections 130 may be different from the distance between the intersection points in the interior of the tank.

Advantageous Effects

According to the X-beam structure and the pressure tank having the same of the present invention, the pressure tank is formed in a prismatic shape, that is, has a prismatic or box-like shape in appearance, such that the pressure tank can by way of modularity be increased to a size of any dimension thereof and can withstand high pressure and temperature change of a fluid.

Further, the tank having the high volume efficiency, that is, the pressure tank is manufactured in a prismatic shape, thereby making it possible to efficiently use the surrounding space thereof.

In addition, the X-beam structure having a lattice shape is mounted in the pressure tank thereby making it possible to reduce the internal fluid sloshing phenomenon due to fluid interaction with the X-beam grid which efficiently creates viscous turbulence that slows wave motion at the internal fluid free surface. This in turn efficiently reduces wave impact on the interior tank walls. In addition, the X-beam structure is manufactured to have a cruciform cross section to have good flexural strength, thereby making it possible to prevent the X-beam structure from being easily damaged.

DESCRIPTION OF DRAWINGS

The above and other objects, features and advantages of the present invention will become apparent from the following description of preferred embodiments given in conjunction with the accompanying drawings, in which:

FIG. 1 is a schematic view of a pressure tank according to the related art;

FIG. 2 is a lattice arrangement view of an X-beam structure according to an embodiment of the present invention;

FIG. 3 is a perspective view of cross portions according to an embodiment of the present invention;

FIG. 4 is an exploded view of cross portions according to an embodiment of the present invention;

FIG. 5 is a partial perspective view showing welded zones between beams meeting at a joint according to an embodiment of the present invention;

FIG. 6 is a perspective view showing a method of manufacturing an X-beam structure according to an embodiment of the present invention;

FIG. 7 is a basic partial perspective view showing an X-beam structure according to another embodiment of the present invention;

FIG. 8 is a partial cross-sectional view of a reinforcing bracket contacting an X-beam structure according to another embodiment of the present invention;

FIG. 9 is a cross-sectional view of a pressure tank mounted in a ship according to an embodiment of the present invention;

FIG. 10 is a partial perspective view showing a method of coupling an X-beam structure to a stiffened tank wall according to an embodiment of the present invention; and FIG. 11 is a partial rear perspective view showing a method of coupling an X-beam structure to a stiffened tank wall according to an embodiment of the present invention.

DETAILED DESCRIPTION OF MAIN ELEMENTS

100: X-beam structure
110: continuous beams
120: attached beams
121: Protrusion
122: cut-out
130: Cross intersection
141,142: Bracket
200: Pressure tank
210: Tank wall
211: Beam structure opening
220: stiffening member

BEST MODE

Hereinafter, a technical spirit of the present invention will be described in detail with reference to the accompanying drawings. However, the accompanying drawings is only an example shown for describing in more detail the technical spirit of the present invention and therefore, the technical spirit of the present invention is not limited to the accompanying drawings.

Overall shape and configuration of an X-beam structure 100 according to an embodiment of the present invention will be described with reference to FIGS. 2 and 3.

An X-beam structure 100 includes a plurality of beams extending in X-axis, Y-axis, and Z-axis directions and formed in a lattice shape and a plurality of cross intersections 130 at which an X-axis beam, a Y-axis beam, and a Z-axis beam meet one another, wherein a cross section of each beam has a right-angled X shape.

The above-mentioned right-angled X shape is manufactured in a cruciform shape, which means that an angle formed when two planes meet each other is at 90°. Herein, everything described below as an X shape has the foregoing shape. In addition, an X axis is orthogonal to a Y axis and a Z axis is orthogonal to an X axis and a Y axis.

The X-axis beams are spaced apart from their adjacent neighboring X-axis beams positioned on the same plane at the same distance, the Y-axis beams are spaced apart from their adjacent neighboring Y-axis beams positioned on the same plane at the same distance, and the Z-axis beams are spaced apart from their adjacent neighboring Z-axis s positioned on the same plane at the same distance.

In more detail, the X-axis beam is spaced apart from the adjacent X-axis beams, respectively, at the same distance, which are positioned on an X-Y plane or an X-Z plane, the Y-axis beam is spaced apart from the adjacent Y-axis beams, respectively, at the same distance, which are positioned on an X-Y plane or a Y-Z plane, and the Z-axis beam is spaced apart from the adjacent Z-axis beams, respectively, at the same distance, which are positioned on an X-Z plane or a Y-Z plane.

The cross intersections 130 according to the present invention will be described in detail with reference to FIGS. 4 and 5.

The X-beam structure 100 is manufactured to have an X-shaped cross section. Such shape has several advantages, but it also represents a challenge when coupling a continuous beam with two other beams at the cross intersections 130 at which the beams meet each other. In order to solve the above-mentioned problems, in the present invention, ends of attached beams 120 are welded to continuous beams 110 consecutively formed at the cross intersections 130.

In more detail, the attached beams 120 have protrusions 121 in an angular shape formed at axial ends thereof and central portions of the protrusions 121 are provided with cut-outs 122 which are consistent with the cross-sectional shape of the continuous beams 110.

That is, the cross intersections 130 are fixed by welding the cut-outs 122 to the continuous beams 110 and welding the protrusions 121 to the adjacent protrusions 121, by welding the cut-outs 122 of the attached beams 120 to the continuous beams 110; in other words, four attached beams 120 are welded onto a continuous beam 110 at each intersectional joint.

In this case, the protrusions 121 and the cut-outs 122 have a smaller cross sectional area from the inside toward the outside and are provided with grooves that can be welded to facilitate butt-welds.

The X-beam structure 100 may be manufactured so that when a distance between the adjacent cross intersections 130 is set to be A at the cross intersections 130, the length of a continuous beam may be 2A or 3A and a length of the attached beam 120 may be one of A, 2A, and 3A.

In addition, both sides of the continuous beam 110 and the attached beams 120 are provided with the protrusions 121, except for shafts positioned at the outermost sides within the tank walls.

A continuous beam 110 may be one of the X-axis beams, the Y-axis beams, and the Z-axis beams in the X-beam lattice structure 100. That is, when a continuous beam 110 is the X-axis direction, the Y-axis beam and the Z-axis beam are attached beams 120 of which the ends are welded onto the X-axis beam, when the continuous beam 110 is in the Y-axis direction, the X-axis beam and the Z-axis beam are attached beams 120 of which the ends are welded onto the Y-axis beam, and when the continuous beam 110 is the Z-axis beam, the X-axis beam and the Y-axis beam are attached beams 120 of which the ends are welded onto the Z-axis beam.

A method of manufacturing the X-beam structure 100 according to the present invention will be described with reference to FIG. 6. In addition, the X-beam structure 100 may be manufactured by building a structure of a single plane, welding the attached beams 120 to the cross intersections 130 and thereafter stacking and welding together plane upon plane.

Therefore, the X-beam structure 100 is not manufactured all at once, but is manufactured by building a unit structure and placing it and attaching it in its appropriate position. Note also that the X-beam structure has an extreme degree of repetitiveness, most of this structure will consist of similar beam sections of one, two or three unit lengths. The X-beam structure 100 may further include brackets 141 and will be described with reference to FIG. 7.

The cross intersections 130 are coupled with each other by welding and therefore, has more degraded strength than that of other portions. Therefore, the brackets 141 are welded to the cross intersections 130 so as to reinforce the cross intersections 130, thereby increasing the strength of the cross intersections 130.

The brackets 141 are formed at a portion at which an end surface parallel with the X axis of the X-axis beam of the cross intersection 130 is orthogonal to an end surface parallel with the Y axis of the Y-axis beam thereof, a portion at which an end surface parallel with the Y axis of the Y-axis beam thereof is orthogonal to an end surface parallel with the Z axis of the Z-axis beam thereof, and a portion at which an end surface parallel with the X axis of the X-axis beam thereof is orthogonal to an end surface parallel with the Z axis of the Z-axis beam thereof.

As shown in FIG. 8, when the length of the bracket 141 is extended for reinforcement, the bracket 141 is manufactured in a rectangular plate shape of having a hole formed at a center thereof like a bracket 142 and may be welded to ends of each shaft (see FIG. 8).

A pressure tank including an X-beam structure 100 according to the embodiment of the present invention will be described in detail with reference to FIGS. 7 and 11.

The pressure tank is manufactured in a prismatic shape and the X-beam structure 100 is disposed in the pressure tank and is connected with each of the tank walls 210.

The above-mentioned prismatic shape is not limited to a hexahedron, but if so desired an angled pressure tank having various shapes can be provided.

The X-beam structure 100 is disposed in a tank body 200 and reaches the other opposite side wall from one side wall of the tank body 200 and is regularly and orthogonally arranged.

Beam structure openings 211 are provided at a place at which the tank wall 210 of the tank body 200 intersects with the X-beam structure 100 in the same shape as the cross section of the X-beam structure 100. In addition, a portion of the beam structure is protruded into the outside wall by inserting the beam structure 100 into the beam structure openings 211 and welding together the X-beams with the wall structure.

In addition, in order to increase the strength of the tank wall 210, stiffening members 220 in an orthogonal shape are disposed at an outer surface of the tank wall 210.

In this configuration, a portion in which the X-beam structure 100 is protruded to the outside is welded to the stiffening members 220 as well as to the tank wall itself.

The distance from the tank wall 210 to the most adjacent beam intersections 130 may be different from the distance between internal beam intersections themselves. Therefore, according to the X-beam structure 100 and the pressure tank having the same of the exemplary embodiment of the present invention, the pressure tank is formed in a prismatic shape, that is, has a prismatic shape in appearance, and has repetitive modular structure, such that the pressure tank can be increased to a size of any dimension thereof and can withstand the high pressure and temperature change of a fluid.

Further, the pressure tank having the high volume efficiency, that is, the pressure tank is manufactured in a prismatic shape, thereby making it possible to efficiently use the surrounding space thereof. This property is particularly important when placing a tank inside tank carrying body such as a ship or an offshore structure.

In addition, the X-beam structure 100 having a lattice shape is mounted in the pressure tank, thereby making it possible to reduce the sloshing phenomenon due to a tank fluid and reducing dynamic impact forces applied to the inner side of the tank wall 210.

In addition, the X-beam structure 100 is manufactured to have a cruciform cross section to have good bending stiffness and strength, thereby making it possible to prevent the X-beam structure 100 from being easily damaged.

The invention claimed is:

1. An X-beam structure, comprising:

a plurality of beams extending in X-axis, Y-axis, and Z-axis directions and formed in a lattice shape and a plurality of cross intersections 130 at which an X-axis beam, a Y-axis beam, and a Z-axis beam meet one another, wherein a cross section of each beam has a right-angled X shape, the cross intersections 130 are provided with continuous beams 110 onto which discontinuous beams 120 are attached or welded to the continuous beams 110, and the attached beams 120 have protrusions 121 in an angular shape formed at ends thereof and central portions of the protrusions 121 are provided with cut-outs 122 into which are consistent with the cross-sectional shape of the continuous beams 110.

2. The X-beam structure of claim 1, wherein the X-axis beam is spaced apart from an X-axis beam positioned on the same plane and adjacent thereto at the same distance, the Y-axis beam is spaced apart from the Y-axis beam positioned on the same plane and adjacent thereto at the same distance, and the Z-axis beam is spaced apart from the adjacent Z-axis beam positioned on the same plane and adjacent thereto at the same distance.

3. The X-beam structure of claim 1, wherein the cross intersections 130 is formed so that a portion at which the cut-out 122 contacts the continuous beam 110 and a portion at which the protrusion 121 contacts the adjacent protrusion 121 have a smaller cross sectional area toward the outside from the inside.

4. The X-beam structure of claim 1, wherein brackets 141 and 142 are welded onto webs of beams meeting at a beam intersection 130.

5. A pressure tank having the X-beam structure of claim 1 comprising a tank body 200 having a high-pressure fluid accommodated therein and manufactured in a prismatic shape, wherein the X-beam structure 100 is disposed in the tank body 200 and reaches the other opposite side wall from one side wall of the tank body 200 and is regularly orthogonally arranged.

6. The pressure tank of claim 5, wherein beam structure openings 211 are provided at a place at which the tank wall 210 of the tank body 200 contacts the X-beam structure 100 in the same shape as the cross section of the X-beam structure 100 and the X-beam structure 100 is extended to the outside of the tank wall 210 by being inserted through the beam structure openings 211.

7. The pressure tank of claim 5, wherein an outer surface of the tank wall 210 is provided with stiffening members 220 in an orthogonal pattern and the beam structure 100 is welded to the stiffening members 220 after being inserted through the tank wall 210 and the stiffening members 220.

8. The pressure tank of claim 5, wherein the distance from the tank wall 210 to the most adjacent the cross intersection 130 is different from corresponding distances between adjacent internal cross intersections 130.

9. A pressure tank having the X-beam structure of claim 2 comprising a tank body 200 having a high-pressure fluid accommodated therein and manufactured in a prismatic shape, wherein the X-beam structure 100 is disposed in the tank body 200 and reaches the other opposite side wall from one side wall of the tank body 200 and is regularly orthogonally arranged.

10. A pressure tank having the X-beam structure of claim 1 comprising a tank body 200 having a high-pressure fluid accommodated therein and manufactured in a prismatic shape, wherein the X-beam structure 100 is disposed in the tank body 200 and reaches the other opposite side wall from one side wall of the tank body 200 and is regularly orthogonally arranged.

11. A pressure tank having the X-beam structure of claim 3 comprising a tank body 200 having a high-pressure fluid accommodated therein and manufactured in a prismatic shape, wherein the X-beam structure 100 is disposed in the tank body 200 and reaches the other opposite side wall from one side wall of the tank body 200 and is regularly orthogonally arranged.

12. A pressure tank having the X-beam structure of claim 4 comprising a tank body 200 having a high-pressure fluid accommodated therein and manufactured in a prismatic shape, wherein the X-beam structure 100 is disposed in the tank body 200 and reaches the other opposite side wall from one side wall of the tank body 200 and is regularly orthogonally arranged.

* * * * *